US006927538B2

(12) United States Patent
Ishizu et al.

(10) Patent No.: US 6,927,538 B2
(45) Date of Patent: Aug. 9, 2005

(54) PHOTOMULTIPLIER TUBE

(75) Inventors: Tomohiro Ishizu, Hamamatsu (JP); Tetsuya Fujita, Hamamatsu (JP)

(73) Assignee: Hamamatsu Photonics K.K., Hamamatsu (JP)

( * ) Notice: Subject to any disclaimer, the term of this patent is extended or adjusted under 35 U.S.C. 154(b) by 118 days.

(21) Appl. No.: 10/333,580

(22) PCT Filed: Jul. 19, 2001

(86) PCT No.: PCT/JP01/06281

§ 371 (c)(1),
(2), (4) Date: Jan. 24, 2003

(87) PCT Pub. No.: WO02/11180

PCT Pub. Date: Feb. 7, 2002

(65) Prior Publication Data

US 2003/0122483 A1 Jul. 3, 2003

(30) Foreign Application Priority Data

Jul. 27, 2000 (JP) ..... 2000-227383

(51) Int. Cl.[7] ..... H01J 43/20; H01J 43/18; H01J 40/14

(52) U.S. Cl. ..... 313/533; 313/535; 313/103 R; 250/207

(58) Field of Search ..... 313/532, 533, 313/534, 535, 536, 524, 103 R, 104, 105 R, 105 CM; 250/207, 214 VT

(56) References Cited

U.S. PATENT DOCUMENTS

| | | | | | |
|---|---|---|---|---|---|
| 4,415,832 | A | * | 11/1983 | Faulkner et al. | 313/533 |
| 4,431,943 | A | * | 2/1984 | Faulkner et al. | 313/533 |
| 4,439,712 | A | * | 3/1984 | Butterwick | 313/533 |
| 4,570,102 | A | * | 2/1986 | McDonie et al. | 313/533 |
| 5,363,014 | A | * | 11/1994 | Nakamura | 313/533 |
| 5,561,347 | A | * | 10/1996 | Nakamura et al. | 313/532 |
| 5,578,891 | A | | 11/1996 | Sakai et al. | |
| 5,598,061 | A | * | 1/1997 | Nakamura et al. | 313/532 |
| 5,914,561 | A | * | 6/1999 | Venkatarao et al. | 313/533 |
| 6,847,028 | B2 | * | 1/2005 | Ishizu et al. | 313/533 |
| 2003/0132370 | A1 | * | 7/2003 | Kimura et al. | 250/214 VT |
| 2003/0146697 | A1 | * | 8/2003 | Ishizu et al. | 313/532 |

FOREIGN PATENT DOCUMENTS

| | | |
|---|---|---|
| DE | 1 464 358 | 5/1969 |
| EP | 0 026 949 | 4/1981 |
| EP | 0 671 757 A1 | 9/1995 |
| JP | Y 52-8377 | 2/1977 |
| JP | 57-98056 | 6/1982 |
| JP | 63174255 | 7/1988 |
| JP | A 1-265445 | 10/1989 |
| JP | 01265445 | 10/1989 |
| JP | 09180670 | 7/1997 |
| JP | A 9-180670 | 7/1997 |
| JP | A 10-214588 | 8/1998 |
| JP | A 2000-136795 | 5/2000 |

* cited by examiner

*Primary Examiner*—Joseph Williams
*Assistant Examiner*—Peter Macchiarolo
(74) *Attorney, Agent, or Firm*—Oliff & Berridge, PLC

(57) ABSTRACT

A photomultiplier that prevents rattling between the dynodes and the base plates, the parts being fixed securely to achieve excellent vibration resistance. The dynode of the second stage (Dy2) includes a curved surface (Dy2A) having an arcuate cross-section and a flat surface (Dy2B) formed continuously and flush with the curved surface. The curved surface (Dy2A) and flat surface (Dy2B) make up the secondary electron emitting surface. Side walls (Dy2C) erected from the curved surface (Dy2A) are formed through a pressing process on either lengthwise end of the curved surface (Dy2A). First ear portions (Dy2D) extend outward from both side walls (Dy2C). Second ear portions (Dy2E) extend outward from both lengthwise ends of the flat surface (Dy2B). The first and second ear portions (Dy2D and Dy2E) are not parallel to each other but form a fixed angle.

7 Claims, 5 Drawing Sheets

PHOTOMULTIPLIER TUBE

TECHNICAL FIELD

The present invention relates to a photomultiplier tube, and particularly to a photomultiplier tube with excellent vibration resistance.

BACKGROUND ART

For photomultiplier tubes used in high-temperature, high-vibration environments, as in oil exploration, noise due to vibrations and degradation over time are problems, since accurate operations are required while drilling deep underground. The electrode in the photomultiplier tube must be securely and fixedly supported, since noise generated during vibrations is caused mainly by displacement of the electrode within the photomultiplier tube.

When forming an electron multiplying portion in a conventional photomultiplier tube, wherein dynodes of a plurality of stages are inserted into and supported by two ceramic base plates, individual support portions are formed on either end of each dynode, and corresponding individual linear portionslits are formed in each ceramic base plate. The support portions are supported through insertion into the corresponding slits.

A photomultiplier tube disclosed in Japanese unexamined patent application publication No. HEI-9-180670 is provided with two support portions protruding one from each end of the second and third dynodes. More specifically, these dynodes are configured from a concave plate part, forming the secondary electron emitting surface, and two upper and lower support plate parts extending from the top and bottom ends of the concave plate part toward the back side thereof. Support portions are formed on both ends of each of the top and bottom support plate parts. Holes are formed in each of two ceramic base plates for engaging the support portions on the two dynodes. Each support portion is supported by inserting the support portions into the corresponding holes and sandwiching each dynode between the two ceramic base plates.

Further, in a photomultiplier tube disclosed in Japanese unexamined patent application publications Nos. SHO-60-262340, SHO-60-254547, and SHO-60-254548, two support portions are formed on both ends of each dynode, extending along the same plane. A single slit corresponding to the two support portions on each dynode is formed in the two base plates. The two support portions are fixed in the base plates by inserting the support portions into the corresponding single slit and bending over the ends of the support portions.

However, when supporting each end of a dynode with a single support portion, rattling tends to occur in the direction of rotation about the support portions. Such movement by the dynodes can affect the output signals.

In the photomultiplier tube of Japanese unexamined patent application publication No. HEI 9-180670, if clearance is provided to enable the dynodes to be easily inserted into the holes, the plate-shaped concave plate portions and the top and bottom support plate portions deform when exposed to severe vibrations, causing the dynodes to rattle severely in the holes. Hence, the dynodes cannot be reliably fixed.

In the photomultiplier tube according to Japanese unexamined patent application publications Nos. SHO-60-262340, SHO-60-254547, and SHO-60-254548, if clearance is provided to enable the dynodes to be easily inserted into the slits, then the dynodes rattle severely in the lengthwise direction of the slits. Hence, the dynodes cannot be reliably fixed.

In view of the foregoing, it is an object of the present invention to provide a photomultiplier tube with good vibration characteristics whose parts can be fixed solidly to prevent rattling between the dynodes and the base plates.

DISCLOSURE OF THE INVENTION

The photomultiplier tube according to the present invention includes a tube-shaped vacuum vessel extending along the tube axis; a photocathode positioned on one end of the tube-shaped vacuum vessel in relation to the tube axis for converting incident light to electrons; a pair of electrically insulating base plates; dynodes of a plurality of stages interposed between the pair of base plates and having secondary electron emitting surfaces formed on their inner walls for multiplying electrons sequentially; and an anode for receiving the electrons multiplied by the plurality of stages of dynodes. At least one dynode from among the dynodes of the plurality of stages is formed of planar first support portions extending outward from both ends of the secondary electron emitting surface on the base plate side; planar second support portions also extending outward from both ends of the secondary electron emitting surface on the base plate side and forming a prescribed angle with the first support portions; first through-holes formed in the pair of base plates for inserting the first support portions; and second through-holes formed in the pair of base plates for inserting the second support portions.

With this construction, the first and second support portions are formed at a prescribed angle in relation to each other. Therefore, rattling of the dynode in the direction of rotation about one support portion is restricted by the other support portion. Even when rattling is generated due to clearance, play, or the like provided for inserting the dynode into the through-holes of the base plate, the directivity and play of the rattling in one support portion is restricted by the other support portion, thereby enabling the dynodes to be reliably and fixedly supported.

In the photomultiplier tube of the present invention, the second support portions are formed shorter than the thickness of the base plates. Hence, the second support portions do not protrude from the outer surfaces of the base plates.

With this construction, the second support portions do not protrude from the base plates when the dynodes are supported therein. Only the first support portions protrude from the base plates. Accordingly, power can be supplied to the dynodes via the first support portions protruding from the outside of the base plates, without wiring or the like interfering with each other. By eliminating the crowding of support portions, the problem of voltage proof destruction caused by support portions of different dynodes being placed close to one another does not occur.

Further, side surface portions disposed perpendicular to the secondary electron emitting surface are formed on both ends of the secondary electron emitting surface near the base plate in at least one dynode. The first support portions are formed on top of the side surface portions.

With this construction, the side surface portions are provided on both ends of the secondary electron emitting surface in the lengthwise direction, thereby preventing electrons from colliding directly with the base plate and charging up the same. The electron trajectories converge on the inner surface due to the potential on both side surface portions. Further, since the side surface portions are disposed one on both lengthwise ends of the secondary electron emitting surface in the dynode, the first support portions are provided on both side surface portions, and the second support portions form a prescribed angle with the first support portions, rattling relative to the first and second support portions is restrained by the side surface portions, thereby more effectively preventing rattling.

Further, in the photomultiplier tube of the present invention, lugs can be formed in an approximate central position on the first or second support portions in the thickness dimension thereof.

Since lugs are formed on the first or second support portions in this construction, the resulting ear parts can be pressed into the corresponding through-holes to fix the dynodes to the base plates satisfactorily.

In the photomultiplier tube of the present invention, it is possible to provide a shielding plate between the dynode of the first stage and the dynodes of the $(n-3)^{th}$ through $n^{th}$ stages.

This construction can prevent light and ions generated when electrons collide with dynodes of the $(n-3)^{th}$ through $n^{th}$ stages from traveling toward the photocathode.

BEST MODE FOR CARRYING OUT THE INVENTION

Figure 1:
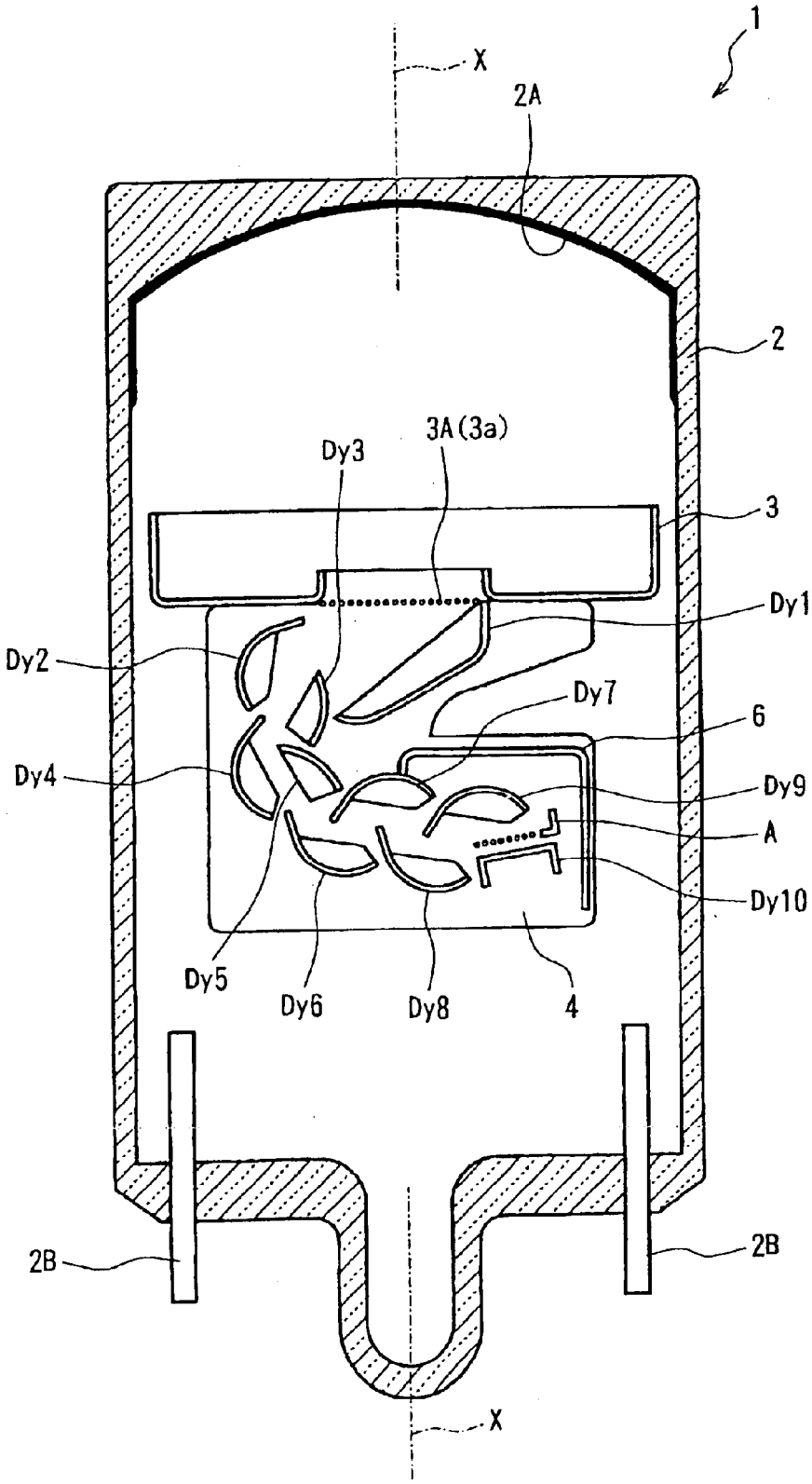
FIG. 1 is a cross-sectional view showing the photomultiplier tube 1 according to an embodiment of the present invention.
Figure 2A:
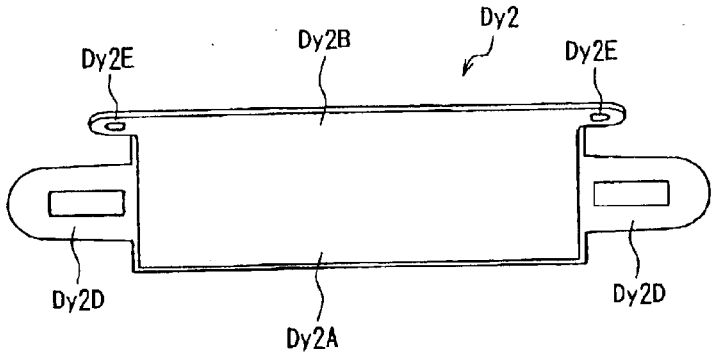
FIG. 2(*a*) is a front view, FIG. 2(*b*) is a bottom view, FIG. 2(*c*) is a side view, and FIG. 2(*d*) is a perspective view showing the shape of the dynodes Dy2, Dy4, and Dy6–Dy9 of the second, fourth, and sixth through ninth stages in the photomultiplier tube 1 according to the embodiment of the present invention.
Figure 2C:
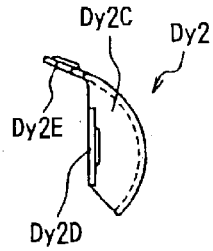
Figure 2B:
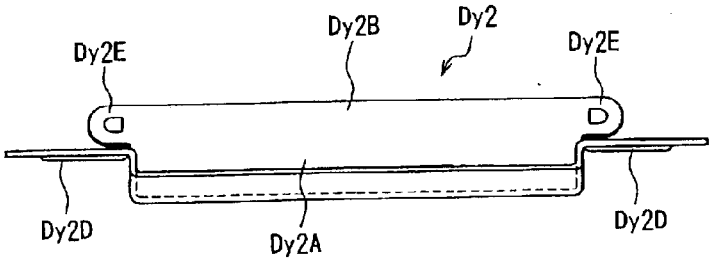
Figure 2D:
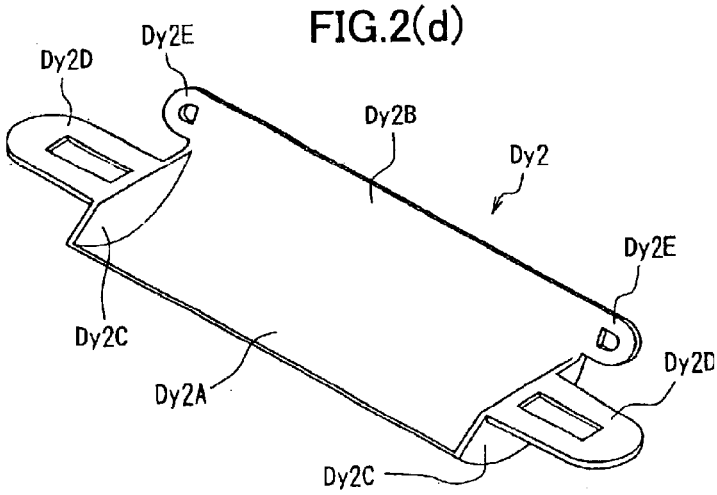
Figure 3A:
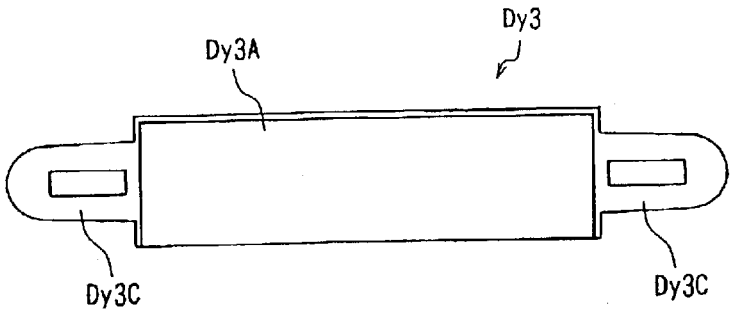
FIG. 3(*a*) is a front view, FIG. 3(*b*) is a bottom view, FIG. 3(*c*) is a side view, and FIG. 3(*d*) is a perspective view showing the shape of the dynodes Dy3 and Dy5 of the third and fifth stages in the photomultiplier tube 1 according to the embodiment of the present invention.
Figure 3C:
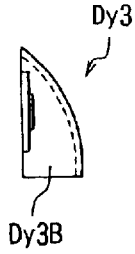
Figure 3B:
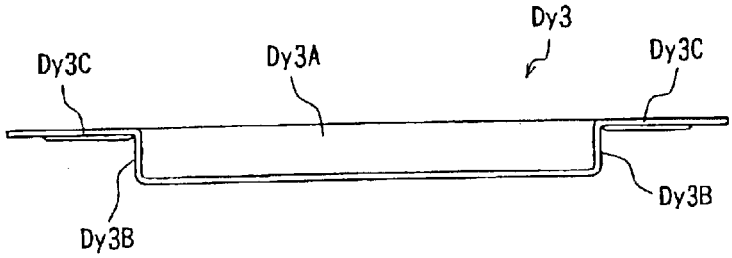
Figure 3D:
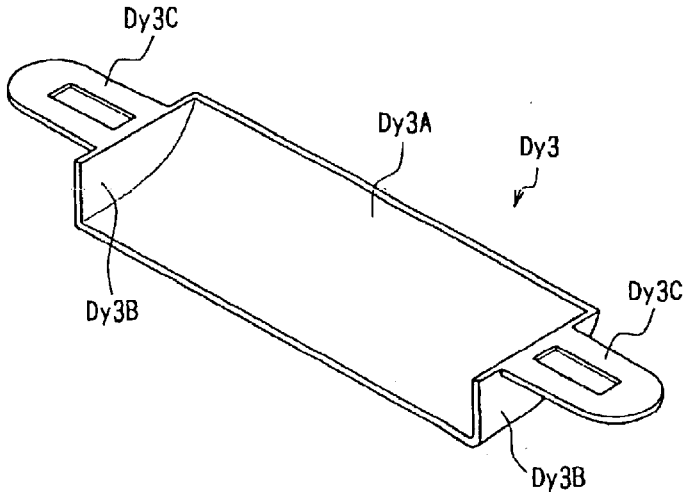

A photomultiplier tube according to an embodiment of the present invention will be described while referring to FIGS. 1 through 6. A photomultiplier tube 1 according to the embodiment includes a tube-shaped vacuum vessel 2 having a tube axis X. FIG. 1 is a cross-sectional view of the photomultiplier tube 1 cut along the tube axis X. The tube-shaped vacuum vessel 2 is formed of Kovar glass or a like material.

Both ends of the tube-shaped vacuum vessel 2 along the tube axis X are closed. One end has a planar shape. A photocathode 2A is formed on the inner surface of this planar end for emitting electrons in response to incident light. The photocathode 2A is formed by reacting an alkali metal vapor with antimony that has been pre-deposited on the inner surface of the end. A plurality of lead pins 2B are provided on the other end of the tube-shaped vacuum vessel 2 for applying prescribed potentials to dynodes Dy1–Dy10 and an anode A. FIG. 1 shows only two of the lead pins 2B for convenience of illustration. Connecting parts not shown in the drawings serve to connect the photocathode 2A to a corresponding lead pin 2B via which a potential of −1000 V is applied.

A cup-shaped focusing electrode 3 having a surface perpendicular to the tube axis X is disposed in a position facing the photocathode 2A. A center opening 3*a* centered at the point of intersection of the tube axis X and on a plane perpendicular thereto is formed in the focusing electrode 3. A mesh electrode 3A is mounted in the center opening 3*a*. The focusing electrode 3 and mesh electrode 3A are connected to corresponding lead pins 2B and have the same potential as the dynode Dy1 of the first stage.

The dynodes Dy1–Dy10 are disposed on the opposite side of the focusing electrode 3 from the photocathode 2A for sequentially multiplying electrons. The dynodes Dy1–Dy10 each have secondary electron emitting surfaces.

The dynode Dy1 of the first stage is disposed at a position facing the center opening 3*a* and intersecting the tube axis X. The dynodes Dy1–Dy10 are disposed such that the secondary electron emitting surfaces of neighboring dynodes oppose each other. The dynodes Dy1–Dy10 are positioned such that the paths formed between spaces of opposing dynodes continue from one to the next and intersect the tube axis X. The anode A is disposed on the opposite side of the tube axis X from the dynode Dy2 of the second stage. That is, as shown in FIG. 1, the dynode Dy2 of the second stage is positioned on the left side of the tube axis X, while the anode A is positioned on the right. The mesh-shaped anode A is positioned between the dynode Dy10 of the tenth stage, serving as the final stage, and the dynode Dy9 of the ninth stage, one stage above the final stage.

Each of the dynodes Dy1–Dy10 and the anode A are connected to corresponding lead pins 2B by wires not shown in the drawings via which prescribed voltages are applied. In the present embodiment, the voltages applied to the dynodes Dy1–Dy10 are as follows: dynode Dy1=−800 V, dynode Dy2=−720 V, dynode Dy3=−640 V, dynode Dy4=−560 V, dynode Dy5=−480 V, dynode Dy6=−400 V, dynode Dy7=−320 V, dynode Dy8=−240 V, dynode Dy9=−160 V, dynode Dy10=−80 V, and anode A=0 V.

The dynodes Dy2, Dy4, and Dy6–Dy9 are formed in identical shapes. FIGS. 2(*a*) through 2(*d*) show the shape of the dynode Dy2 in more detail. The dynode Dy2 has a curved surface Dy2A having an arcuate cross-section and a flat surface Dy2B formed continuously and flush with the curved surface Dy2A. The curved surface Dy2A and flat surface Dy2B make up the secondary electron emitting surface. Side walls Dy2C erected from the curved surface Dy2A are formed through a pressing process on either lengthwise end of the curved surface Dy2A. First ear portions Dy2D forming the first support portions extend outward from both side walls Dy2C. Second ear portions Dy2E forming the second support portions extend outward from both lengthwise ends of the flat surface Dy2B. The first and second ear portions Dy2D and Dy2E are not parallel to each other but form a fixed angle. Lugs are formed in the centers of the first ear portions Dy2D and second ear portions Dy2E.

The dynodes Dy3 and Dy5 of the third and fifth stages also have the same shape. FIGS. 3(*a*) through 3(*d*) show the shape of the dynode Dy3 of the third stage in more detail. The dynode Dy3 of the third stage has a curved surface Dy3A with an arcuate cross-section. The curved surface Dy3A forms the secondary electron emitting surface and has a smaller surface area than the secondary electron emitting surfaces of dynodes in other stages (Dy2A+Dy2B). With this construction, the dynode Dy3 (and dynode Dy5) is formed smaller than dynodes of other stages. Further, side walls Dy3B protrude from each end of the curved surface Dy3A and are formed by a pressing process. First ear portions Dy3C are formed in a planar shape and extend outward from the side walls Dy3B perpendicular to the same on the opposite side from the curved surface Dy3A. Lugs are formed in the center portions of the first ear portions.

Figure 6:
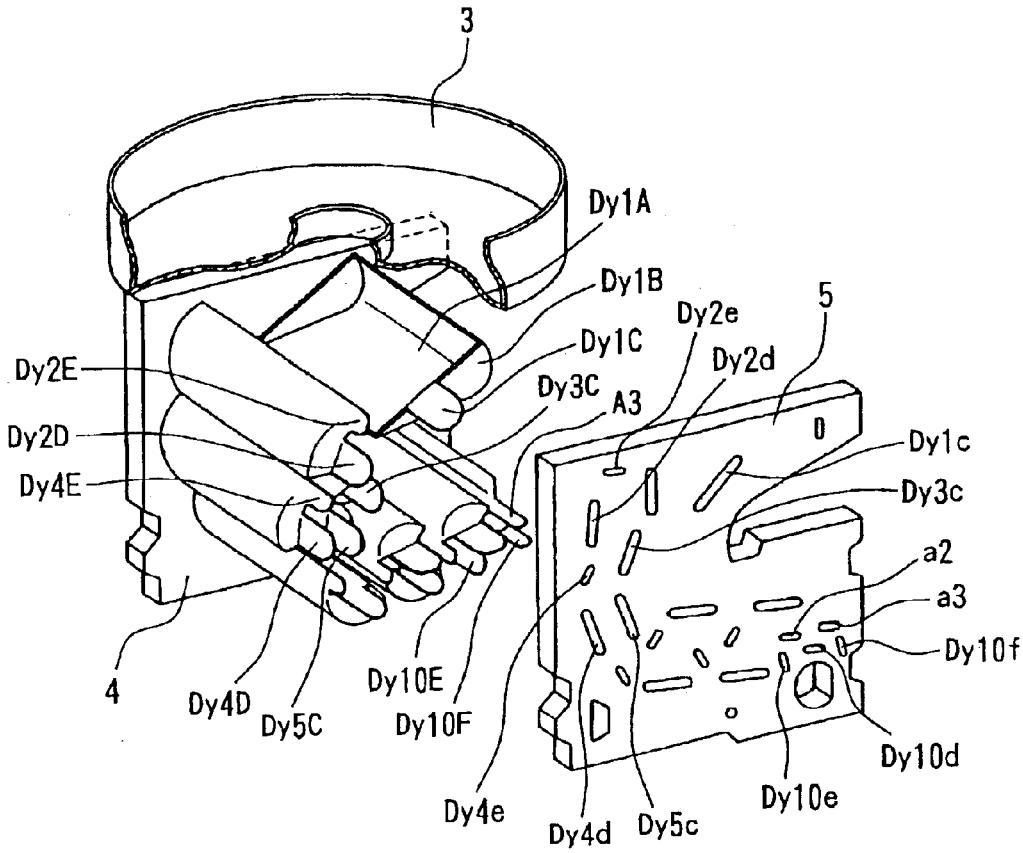
FIG. 6 is a perspective view showing how the dynodes Dy1–Dy10 and the anode A are inserted into the base plate 5.

As can be seen in FIG. 6, side surfaces Dy1B stand upward from secondary electron emitting surfaces Dy1A on both lengthwise ends thereof, while first ear portions Dy1C extend outward from the side surfaces Dy1B. Lugs are formed in the center portions of the first ear portions Dy1C.

Figure 5:
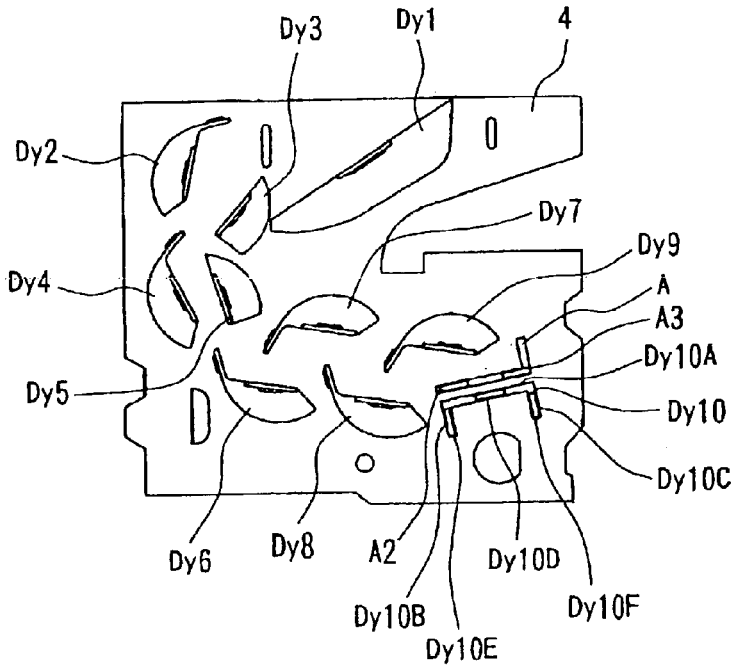
FIG. 5 is a front view showing the dynodes Dy1–Dy10 and the anode A retained in the base plate 4.

As shown in FIG. 5, the dynode Dy10 of the tenth stage has a planar secondary electron emitting surface Dy10A and two surfaces Dy10B and Dy10C standing out from both ends of the secondary electron emitting surface Dy10A. Hence, the dynode Dy10 of the tenth stage is formed in the shape of a three-sided rectangle. Three ear portions Dy10D, Dy10E, and Dy10F extend along the same plane as the secondary electron emitting surfaces Dy10A, Dy10B, and Dy10C, respectively and are formed on both lengthwise ends of the same. The ear portions Dy10E and Dy10F are parallel to one another, but perpendicular to the ear portions Dy10D. Lugs are formed in the center portions of the ear portions Dy10D, Dy10E, and Dy10F.

Figure 4:
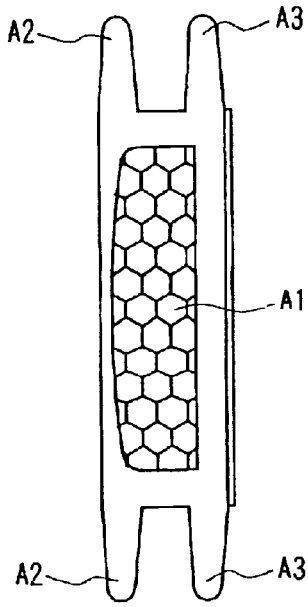
FIG. 4 is a front view showing the anode A in the photomultiplier tube 1 according to the embodiment of the present invention.

As shown in FIG. 4, the anode A has a secondary electron receiving portion A1 including a flat-shaped mesh construction. Ear portions A2 and A3 formed on the same plane as the receiving portion A1 extend outward from both lengthwise ends of the same.

As shown in FIG. 6, the dynodes Dy1–Dy10 and the anode A are supported on both lengthwise ends in base plates 4 and 5. Slit-shaped fixing holes Dy1*c*, Dy2*d*, Dy2*e*, Dy3*c*, Dy4*d*, Dy4*e*, Dy5*c*, Dy10*d*, Dy10*e*, Dy10*f*, a2, and a3 are formed in the base plate 5. Although not shown in the drawings, identical slit-shaped fixing holes are formed in the base plate 4.

FIG. 5 is a front view showing the dynodes Dy1–Dy10 and the anode A supported in the base plate 4 but not yet supported in the base plate 5. FIG. 6 shows the dynodes Dy1–Dy10 and the anode A about to be inserted into the base plate 5. The following description is identical for the case of supporting the ear portions Dy1C, Dy2D, Dy2E, Dy3C, Dy4D, Dy4E, Dy5C, Dy10D, Dy10E, and Dy10F of the dynodes Dy1–Dy10 and the anode A in the base plate 4.

The dynode Dy1 of the first stage is supported in the base plate 5 by inserting the first ear portions Dy1C into the fixing holes Dy1*c*. The dynode Dy2 of the second stage is supported in the base plate 5 by inserting the first ear portions Dy2D into the fixing holes Dy2*d* and the second ear portions Dy2E into the fixing holes Dy2*e*. The dynode Dy3 of the third stage is supported in the base plate 5 by inserting the first ear portions Dy3C into the fixing holes Dy3*c*. The dynode Dy4 of the fourth stage is supported in the base plate 5 by inserting the ear portions Dy4D into the fixing holes Dy4*d* and the ear portions Dy4E into the fixing holes Dy4*e*. The dynode Dy5 of the fifth stage is supported in the base plate 5 by inserting the ear portions Dy5C into the fixing holes Dy5*c*. As with the dynodes Dy2 and Dy4 of the second and fourth stages, the dynodes Dy6–Dy9 are supported in the base plate 5 by inserting the first ear portions and second ear portions into the corresponding fixing holes. The dynode Dy10 of the tenth stage is supported in the base plate 5 by inserting the ear portions Dy10D into the fixing holes Dy10*d*, the ear portions Dy10E into the fixing holes Dy10*e*, and the ear portions Dy10F into the fixing holes Dy10*f*. The anode A is supported in the base plate 5 by inserting the ear portions A2 into the fixing holes a2 and the ear portions A3 into the fixing holes a3.

By forming the lugs in each ear portion, as described above, the ear portions can be force-fitted into their corresponding fixing holes at this time. The dynodes Dy1–Dy10 are suitably fixed in the base plate 5. The same is true for the ear portions of the dynodes Dy6–Dy10 of the sixth through ninth stages.

At this time, the first ear portions Dy1C, Dy2D, Dy3C, Dy4D, and Dy5C, and the ear portions Dy10E, Dy10F, A2, and A3 are formed longer than the thickness of the base plate 5, thereby protruding from the other side of the base plate 5. These ear portions serve as terminals for connecting to the lead pins 2B. The same is true for the first ear portions in the dynodes Dy6–Dy9 of the sixth through ninth stages. By twisting the parts of the ear portions Dy1C, Dy2D, Dy3C, Dy4D, Dy5C, Dy10E, Dy10F, A2, and A3 protruding from the base plate 5, the dynodes Dy1 through Dy5 and Dy10 and the anode A can be more securely fixed to the base plate 5. The same effect is true for the dynodes Dy6–Dy9 of the sixth through ninth stages.

The second ear portions Dy2E and Dy4E and the ear portion Dy10D are each formed shorter than the thickness of the base plate 5. These ear portions do not protrude from the outer side of the base plate 5 and therefore do not interfere with the wiring. The same description is true for the second ear portions on the dynodes Dy6–Dy9 of the sixth through ninth stages. Since the number of ear portions protruding from the base plate 5 can be decreased in this way, it is possible to avoid putting wiring of neighboring ear portions on dynodes Dy1–Dy10 in close proximity of one another, thereby preventing the problem of voltage proof destruction.

Normally, secondary electrons emitted from the secondary electron emitting surface of a dynode Dyi of the $i^{th}$ stage impinge on a portion of high efficiency of the secondary electron emitting surface in the dynode Dy(i+1) of the $(i+1)^{th}$ stage. Accordingly, the dynode Dy(i+2) of the $(i+2)^{th}$ stage is configured to penetrate between the secondary electron emitting surface of the dynodes Dyi and Dy(i+1) of the $i^{th}$ and $(i+1)^{th}$ stages, respectively. In the photomultiplier tube 1 of the present embodiment, the dynodes Dy1–Dy10 are arranged in a curving series in order that the path formed in the spaces between dynodes cuts across the tube axis. Accordingly, a greater distance is formed between dynodes arranged on the outer part of the curve. Consequentially, the dynode Dy(i+2) of the $(i+2)^{th}$ stage positioned on the outer side of the curve generally does not penetrate between the secondary electron emitting surfaces of the dynodes Dyi and Dy(i+1) of the $i^{th}$ and $(i+1)^{th}$ stages. However, the secondary electron emitting surfaces of the dynodes Dy2, Dy4, Dy6, and Dy8 of the second, fourth, sixth, and eighth stages disposed on the outer part of the curve in the present embodiment are formed continuously with the curved surfaces Dy2A, Dy4A, Dy6A, and Dy8A having an arcuate cross-section. Therefore, as shown in FIG. 1, the dynode Dy(i+2) of the $(i+2)^{th}$ stage penetrates between the secondary electron emitting surfaces of the dynodes Dyi and Dy(i+1) of the $i^{th}$ and $(i+1)^{th}$ stages. As a result, the potential of the dynode Dy(i+2) of the $(i+2)^{th}$ stage leaks between the dynodes Dyi and Dy(i+1) of the $i^{th}$ and $(i+1)^{th}$ stages. Hence, secondary electrons emitted from the secondary electron emitting surface of the dynode Dyi of the $i^{th}$ stage are attracted to the dynode Dy(i+2) of the $(i+2)^{th}$ stage, enabling secondary electrons to be impinged on the part of high efficiency in the secondary electron emitting surface of the Dy(i+1) of the $(i+1)^{th}$ stage.

Here, the secondary electron emitting surfaces of the dynodes Dy3 and Dy5 of the third and fifth stages are formed only by the parts having an arcuate cross-section in order to facilitate reception of electrons from the dynodes Dy2 and Dy4 of the previous stages. Moreover, the secondary electron emitting surfaces are adjusted to emit electrons in a direction slightly toward the dynodes Dy2 and Dy4 of the previous stages so that the secondary electrons trace a correct trajectory in relation to the dynodes Dy4 and Dy6 of the next stages. If the secondary electron emitting surfaces of the dynodes Dy3 and Dy5 of the third and fifth stages were flat, too much potential of the dynodes Dy3 and Dy5 would leak between the dynodes Dy2 and Dy4 of the previous stage and the dynodes Dy1 and Dy3 of one more previous stages, causing electrons from the dynodes Dy1 and Dy3 to be attracted to the back surfaces of the dynodes Dy3 and Dy5. This would make it difficult to impinge secondary electrons on the secondary electron emitting surfaces of the dynodes Dy2 and Dy4. Electrons emitted from the secondary electron emitting surfaces of the dynodes Dy2 and Dy4 would be attracted to the potential of the dynodes Dy5 and Dy7. Accordingly, the electrons would either not impinge at a desirable position on the dynodes Dy3 and Dy5 or would slip past the next stages of dynodes and impinge on the back surfaces of the dynodes Dy5 and Dy7.

Further, the secondary electron emitting surfaces of the dynodes Dy3 and Dy5 of the third and fifth stages have a smaller surface area than the secondary electron emitting surfaces of the dynodes Dy2, Dy4, and Dy6 through Dy9 of the second, fourth, and sixth through ninth stages in order to reduce the size of the dynodes Dy3 and Dy5 of the third and fifth stages arranged in the center of the curved series of dynodes. Hence, the dynodes Dy1–Dy10 can be arranged in a curved series such that the path in the spaces between dynodes crosses the tube axis. On the other hand, the secondary electron emitting surfaces of the dynodes Dy7 and Dy9 of the seventh and ninth stages arranged on the inner side of the curved series have the same surface area as the secondary electron emitting surfaces of the dynodes Dy2, Dy4, Dy6, and Dy8 of the second, fourth, sixth, and eighth stages arranged on the outer side of the curved series in order to slightly relax the increasing density of electrons near the secondary electron emitting surfaces of the dynodes Dy7 and Dy9 positioned relatively close to the final stage.

As shown in FIG. 1, a flat shielding plate 6 is provided parallel to the photocathode 2A and positioned around the dynodes Dy1–Dy10. The shielding plate 6 is positioned between the dynodes Dy7–Dy10 near the final stage and the dynode Dy1 of the first stage to prevent light or ions generated when electrons collide with the dynodes Dy7–Dy10 near the final stage from migrating toward the photocathode 2A. A prescribed voltage is applied to the shielding plate 6 by connecting the shielding plate 6 to a corresponding lead pin 2B.

Next, the operations of the photomultiplier tube 1 according to the embodiment will be described with reference to FIG. 1. When light is incident on the photocathode 2A, photoelectrons are emitted. The photoelectrons are converged by the focusing electrode 3 and transferred to the dynode Dy1 of the first stage. At this time, secondary electrons are emitted from the dynode Dy1 and sequentially transmitted to the dynodes Dy2 through Dy10 of the second through tenth stages, causing an amplification cascade of sequentially generated secondary electrons. Ultimately, the secondary electrons are collected in the anode A and extracted therefrom as an output signal.

The photomultiplier tube according to the present invention is not limited to the embodiment described above, but may be subjected to many modifications and variations without departing from the spirit of the invention, the scope of which is defined by the attached claims. In the present embodiment, for example, line focus dynodes of a plurality of stages are positioned such that a curved path is formed by the spaces therebetween. However, the present invention also applies when line focus dynodes of a plurality of stages are arranged in a normal inline formation.

INDUSTRIAL APPLICABILITY

The present invention described above can be applied to a wide range of applications requiring high precision optical detection and requiring good vibration resistance, as in oil exploration and the like, and good pulse linearity characteristics.

What is claimed is:

1. A photomultiplier tube comprising:

a tube-shaped vacuum vessel extending along a tube axis, the tube-shaped vacuum vessel having a first end and a second end in relation to the tube axis;

a photocathode positioned on the first end of the tube-shaped vacuum vessel, for converting incident light to electrons and emitting the electrons;

a pair of electrically insulating base plates, each of the pair of electrically insulating base plates having a predetermined thickness;

a plurality of dynodes arranged in n stages, the plurality of dynodes including through $n^{th}$ stage dynodes wherein n is an integer, the plurality of dynodes being supported between the pair of electrically insulating base plates and having secondary electron emitting surfaces formed on inner walls for multiplying electrons sequentially; and an anode for receiving the electrons multiplied by the plurality of dynodes;

wherein at least one dynode from among the plurality of dynodes includes:

the secondary electron emitting surface having a curved surface of an arcuate cross-section and a flat surface formed continuously and flush with the curved surface:

first support portions extending outward from both ends of the curved surface on a base plate side; and second support portions extending outward from both ends of the flat surface on the base plate side and forming a prescribed angle with the first support portions; and wherein the pair of electrically insulating base plates is formed with first through-holes for receiving the first support portions and second through-holes for receiving the second support portions.

2. The photomultiplier tube as recited in claim 1, wherein the second support portions are formed shorter than the predetermined thickness so as not to protrude from outer surfaces of the pair of electrically insulating base plates.

3. The photomultiplier tube as recited in claim 2, wherein the at least one dynode is formed on both ends of the secondary electron emitting surface with side walls that are perpendicular to the secondary electron emitting surface, and the first support portions are formed on top of the side walls.

4. The photomultiplier tube as recited in claim 1, wherein the at least one dynode is formed on both ends of the secondary electron emitting surface with side walls that are perpendicular to the secondary electron emitting surface, and the first support portions are formed on top of the side walls.

5. The photomultiplier tube as recited in claim 1, wherein lugs are formed in an approximate central position on the first support portions or second support portions in the thickness dimension thereof.

6. The photomultiplier tube as recited in claim 1, further comprising a shielding plate disposed between the first stage dynode, and an $(n-3)^{th}$ stage dynode through the $n^{th}$ stage dynode of the plurality of dynodes.

7. The photomultiplier tube as recited in claim 6, wherein the shielding plate is disposed parallel to the photocathode.

* * * * *